US005855254A

United States Patent [19]

Blochle

[11] Patent Number: 5,855,254

[45] Date of Patent: Jan. 5, 1999

[54] CABLE-CLAMPING DEVICE FOR A SYNTHETIC FIBER CABLE

[75] Inventor: Hans G. Blochle, Stans, Switzerland

[73] Assignee: Inventio AG, Hergiswil, Switzerland

[21] Appl. No.: 506,140

[22] Filed: Aug. 21, 1995

[30] Foreign Application Priority Data

Aug. 29, 1994 [CH] Switzerland ..... 02 628/94

[51] Int. Cl.[6] ..... B66B 7/08

[52] U.S. Cl. ..... 187/411; 254/388; 294/1.1

[58] Field of Search ..... 187/411, 413; 254/388, DIG. 14; 294/1.1

[56] References Cited

U.S. PATENT DOCUMENTS 1,436,566 11/1922 Beaumont .

FOREIGN PATENT DOCUMENTS 3403101 7/1985 Germany .
1067687 5/1967 United Kingdom .

OTHER PUBLICATIONS

European Search Report.

*Primary Examiner*—Kenneth Noland
*Assistant Examiner*—Khoi M. Tran
*Attorney, Agent, or Firm*—Greenblum & Bernstein, P.L.C.

[57] ABSTRACT

Cable-clamping device for a synthetic fiber cable. A cable-clamping device for highly loaded synthetic fiber cables for elevator installations, wherein the cables can tolerate only small lateral pressures, the device including at least one retaining drum firmly connected with the elevator car and the elevator counterweight, with the retaining drum having several adjacent cable grooves, whose groove courses end or run out adjacently to the other for the running-off of the cables, with the cable grooves becoming progressively narrower in their cross-section starting at the entry of the loaded cable, with up to four and more retaining drums being arranged, one behind and beside the other, in this manner, wherein the run-off regions of the cable grooves point towards one another in order to avoid a fanning-out of the cables in front of the drive pulley.

45 Claims, 5 Drawing Sheets

CABLE-CLAMPING DEVICE FOR A SYNTHETIC FIBER CABLE

CROSS REFERENCE TO RELATED APPLICATIONS

This application claims the priority of Swiss Application No. CH 02 628/94-3, filed Aug. 29, 1994, the disclosure of which is incorporated herein by reference in its entirety.

BACKGROUND OF THE INVENTION

1. Field of the Invention

The invention pertains to a cable-clamping device for synthetic fiber cables for suspending an elevator car, the device comprising at least one retaining drum having at least one cable groove for the reception of the load-bearing cable.

2. Discussion of the Background of the Invention and Material Information

Such a device, used for the staying of aerial or telescopic masts, which includes a round rod fastened on a base plate and has an incised threaded impression, is known from DE 34 03 101 C1. This cable clamp is suitable only for a single cable and, in comparison with the diameter of the cable, is of relatively large and voluminous overall construction.

For certain applications such as elevator installations, long cable lengths are necessary, on the one hand, and the requirement for the smallest possible moving masses exists, for energy reasons, on the other hand. High-tensile fiber cables of one-dimensional elongate molecule chains and a fully enveloping protective polyurethane sleeve meet these requirements. Such cables are light, have a small diameter and substantial tensile strength. Such cables can only absorb small transverse forces, brought about by clamping or pressing, without reducing the tensile strength thereof.

On the other hand, several cables must be fastened in a closely adjacent manner in elevator installations. At the counterweight, for example, only a narrow surface of a width of generally only 10 to 15 centimeters is, as a rule, available for fastening the cables. In the case of such space conditions, the known cable-clamping device is not usable due to its bulkiness. Projecting cable-clamping devices fan out the cable strand, which leads to excessive wear of the cables and the cable grooves, in particular when the elevator car or the counterweight come into the proximity of the drive pulley or the deflecting roller.

SUMMARY OF THE INVENTION

The invention as set forth in the appended claims solves the task of avoiding the disadvantages of the known device and produces a cable-clamping device, for high loads, suitable for synthetic fiber cables and enables the secure fastening of a larger number of closely adjacent cables. This cable connection fulfills, in particular, the requirements of elevator operations, where high loads must be fixed on a small mounting area.

Specifically, a first embodiment of this invention pertains to a cable-clamping device for load-bearing synthetic fiber cables for suspending an elevator car, the device comprising at least one retaining drum having at least one cable groove for the reception of the load-bearing cable, the at least one retaining drum being firmly connected with at least one of the car and a counterweight of an elevator, with at least one retaining drum being provided with a plurality of adjacent cable grooves, with the cable grooves having groove courses that one of terminate and run out, one directly beside the other, for a run-off of the cables, with the cable grooves progressively converging, in cross-section, from an entry of a cable under load.

A further embodiment of the cable-clamping device of this invention includes several retaining drums arranged in one of a row and adjacent to each other, wherein run-off regions of the cable grooves face each other.

In another embodiment of the cable clamping device of this invention, the cable groove is of a size to accept several superposed windings of the cable.

A differing embodiment of the cable-claiming device of this invention further includes co-axially arranged cable grooves, each groove being wound with cables to about half of an axial extent of the cable grooves in an oppositely threaded manner.

In yet a further embodiment of the cable-clamping device of this invention, the cables, at unloaded ends thereof, are retained in the cable grooves by lateral pressure, via clamping brackets.

In yet another embodiment of the cable-clamping device of this invention, the cables are secured in the cable grooves, against dropping-out, by securing brackets.

A yet differing embodiment of the cable-clamping device of this invention further includes co-axially arranged retaining drums having cable grooves, with each groove being oppositely directed, wherein the cables are wound on in a same winding direction so that the fastened cable ends each tend to move towards the mutually remote ends of the retaining drums.

A still further embodiment of the cable-clamping device of this invention includes multiple adjacently arranged retaining drums, with the drums including oppositely directed cable grooves, wherein the winding direction of the cables is also oppositely directed.

In still another embodiment of the cable-clamping device of this invention, the cable grooves are spiral grooves arranged helically on the retaining drums.

In still a differing embodiment of the cable-clamping device of this invention, the cable grooves are planar spiral grooves winding around one point.

The advantages achieved by the invention are in that the fastened cables can run one next to each other over the closely adjacent grooves of the drive pulley without significant deflection. In particular, when the elevator car or the counterweight reaches the point nearest to the drive pulley, a uniform loading of all cables is achieved thereby and no transverse forces arise, which—particularly in the case of cables lying at the outside—could lead to a stripping-off of the cables from the drive pulley.

The mode of construction, which is short, when viewed in the directional extent of the shaft, has the additional advantage that the shaft length can be fully utilized or that no additional increase in shaft height is required.

In addition, the tension force in the cable is largely taken up by the cable-clamping device by way of the high co-efficient of friction of the polyurethane sleeve in the cable groove and the cable is not stressed by clamping, transversely to the directional extent of the fibers, which reduces the load-carrying capacity, particularly on entry of the cable into the run-off region of the cable grooves. It is also an advantage that sheathed synthetic fiber cables can be fastened without cutting same open or damaging of the protective sheathing thereof.

BRIEF DESCRIPTION OF THE DRAWINGS

The invention which is set forth with reference to several embodiments thereof will be better understood and objects other than those set forth above will become apparent when consideration is given to the following detailed description thereof. Such description makes reference to the annexed drawings wherein throughout the various figures of the drawings, there have generally been used the same reference characters to denote the same or analogous components and wherein.

DETAILED DESCRIPTION OF THE PREFERRED EMBODIMENTS AND BEST MODE

With respect to the drawings it is to be understood that only enough of the construction of the invention and the surrounding environment in which the invention is employed have been depicted therein, in order to simplify the illustrations, as needed for those skilled in the art to readily understand the underlying principles and concepts of the invention.

Figure 1:
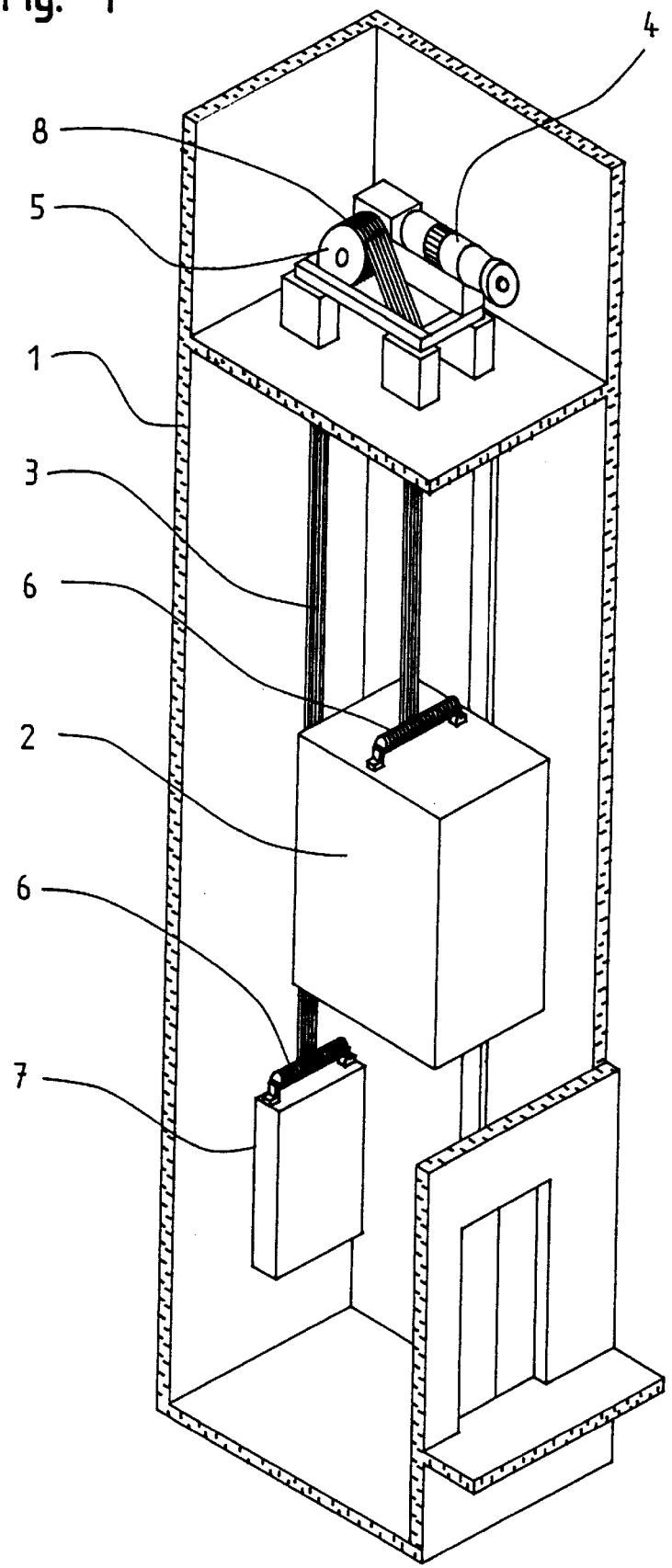
FIG. 1 is a schematic elevational view of an elevator installation having an elevator car and a counterweight.

Turning now to FIG. 1, an elevator car 2, guided in an elevator shaft 1, is suspended via several cables 3 of synthetic fibers, with cables 3 running over a drive pulley 5 connected with a motor 4. Cable-clamping devices 6, via which the cables are fastened at one end, are located at the top of car 2. The respective other ends of cables 3 are fastened in a like manner at a counterweight 7, which is likewise guided in shaft 1. Drive pulley 5 includes six closely adjacent grooves 8, one for each of a respective cable. Drive pulleys having two to twelve grooves are generally utilized in elevator installations. On the uppermost floor, car 2 reaches its point nearest to the drive pulley, i.e. the cable-clamping devices 6 are situated directly below drive pulley 5. When the car stops at the lowest floor, the cable-clamping devices 6, mounted on the upper portion of counterweight 7, are situated directly below drive pulley 5.

Figure 2:
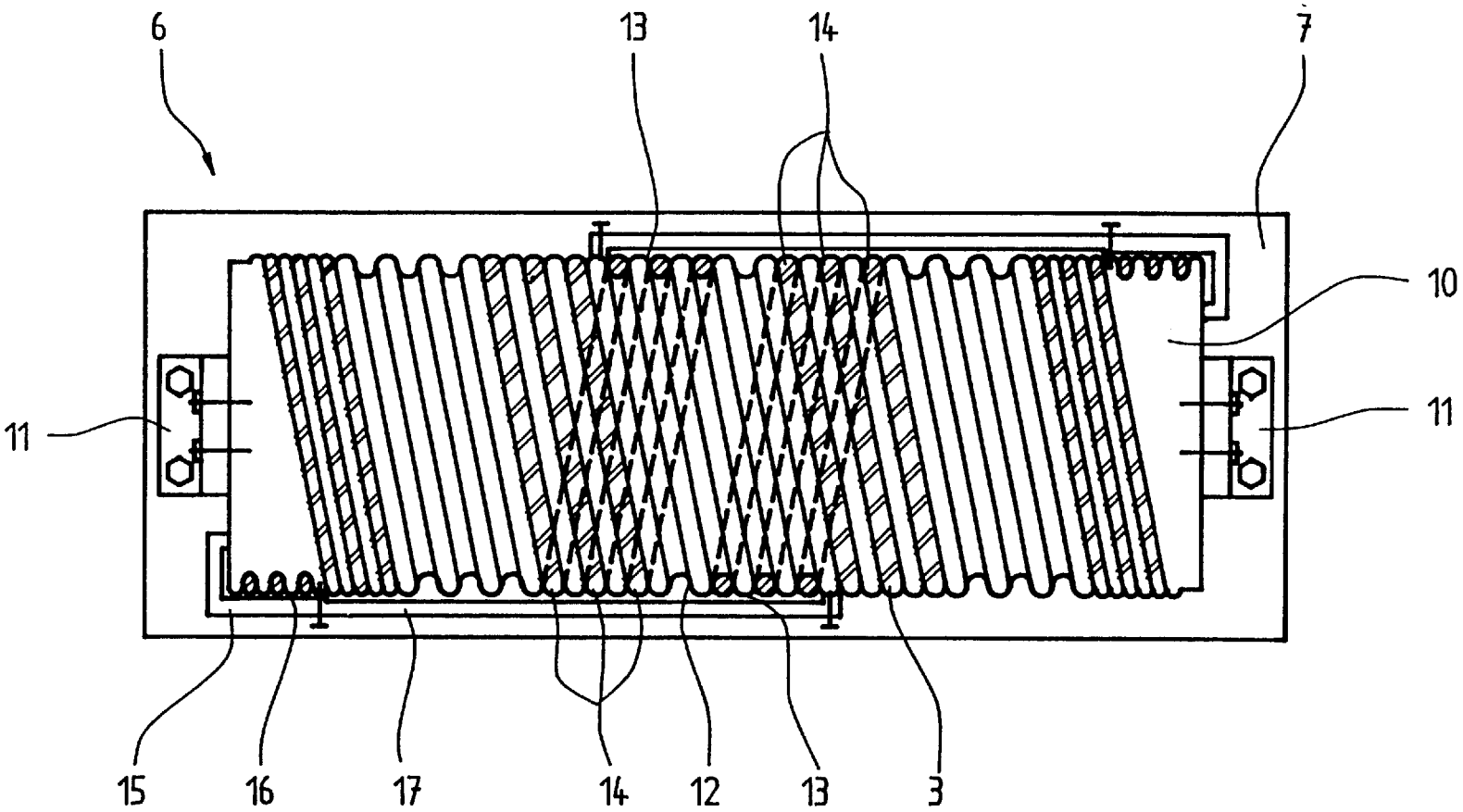
FIG. 2 is an enlarged top plan view of a cable-clamping device according to a first exemplary embodiment of this invention.

FIG. 2 shows the details of a cable-clamping device 6 only portions of the cables 3 being shown in the drawing in the interest of greater clarity. A cylindrical retaining drum 10, which here for example is attached onto counterweight 7 via bent-over or angled metal retaining plates 11, in a non-displaceable and non-rotatable manner, extends transversely to the direction of the cable, which in FIG. 2 extends perpendicularly to the plane of the paper sheet. Three mutually adjacent cable grooves 12, which are formed as helically shaped spiral grooves extend in the same twist direction, over the entire length of the retaining drum, this simplifying the production thereof. One respective cable group 14, of three cables 3 each, is wound onto cables grooves 12 from a run-off region 13 in the middle or center of the retaining drum towards both of its ends. Both of cable groups 14 therefore run, spaced from each other, from opposite sides of retaining drum 10. When viewed transversely to the axis of retaining drum 10, the cables 3 however lie directly adjacent to each other as they run onto the drive pulley with six adjacently arranged grooves.

The groove width of cable grooves 12, at the entry or the run-off of the cables 3 in the middle of retaining drum 10, corresponds to the cable diameter. Thereby, a lateral pressing, which reduces the load carrying capacity of the cable, is avoided. At the entry of the loaded cables, the cable grooves 12 become progressively narrower in their cross-section so that the cable is gradually increasingly clamped laterally with reduced tension loading. In the drawing, the continuous reduction in cross-section is illustrated as a step change for reasons of simplicity. The unloaded cable ends are fixed by clamping yokes (brackets) 15 in the cable grooves, which yokes are inserted in the end faces and fixedly retained at retaining drum 10 after the first thread-shaped groove pitch or course 16 of all cable grooves 12. Clamping yoke 15 are extended by loosely abutting securing brackets 17, which have the greatest possible area and extend in the axial direction of retaining drum 10 as well as transversely across the cables 3 without being pressed thereagainst. Securing brackets 17 prevent a dropping or falling out of the slack cables 3, from cable grooves 12, at the unloaded cable ends thereof.

In the exemplary embodiment, the retaining drum has 3½ usable groove courses or pitches 16. Depending upon the magnitude of the load and the frictional conditions, more or less groove courses or pitches can also be provided. This embodiment makes it clear that even a single spiral groove, which is wound upon by one respective cable from both ends, would already suffice for simple elevators having only two cables.

The effective tension force in a cable 3 is successively transmitted to retaining drum 10 by way of friction in associated cable groove 12. The synthetic fiber cable 3 is increasingly clamped laterally in the further course of the cable groove 12 becoming narrower. The transverse forces, which in this case gradually increase in retaining drum 10 with an increasing reduction in the tension force, remain locally so small that the original tensile strength of cable 3 is not reduced.

In the case of the expansion of a cable 3 caused by tensile stress, the cable can easily be retensioned in that it is at least partially unwound from retaining drum 10 and subsequently again rewound thereon with a shortened cable length. No tools are required for this operation. A protruding cable end is simply cut off.

Figure 3:
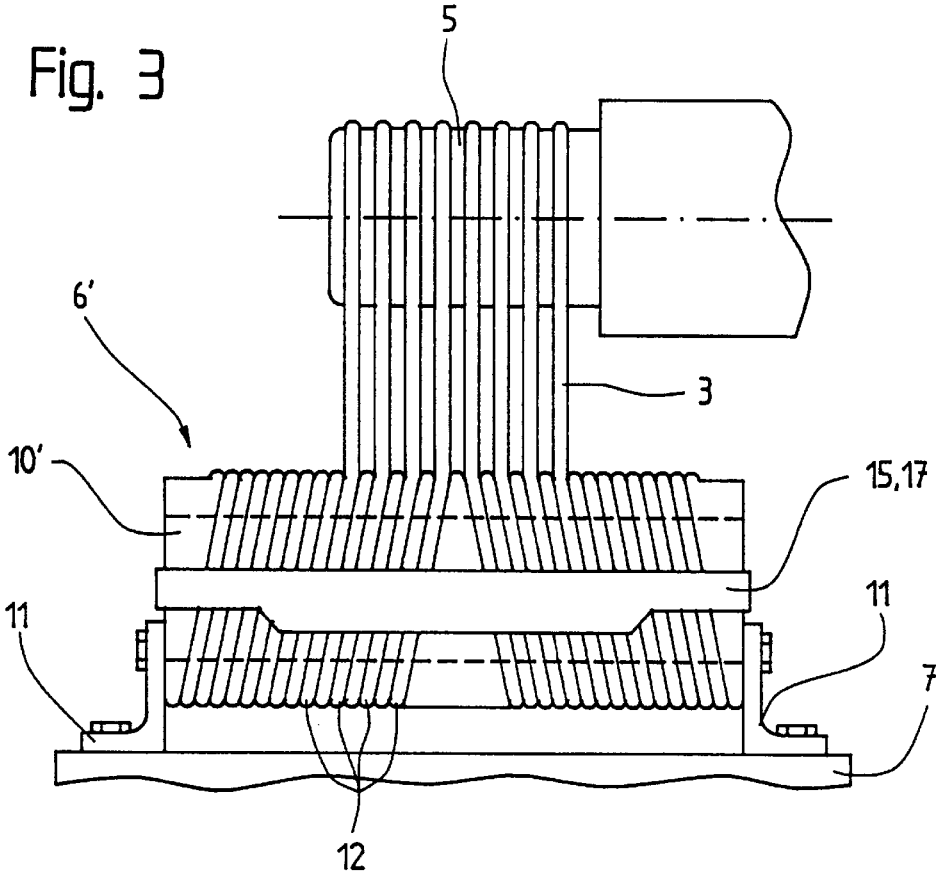
FIG. 3 is a side elevational view of a second exemplary embodiment of a cable-clamping device of this invention.

In the second exemplary embodiment, according to FIG. 3, the cable-clamping device 6' consists of only one retaining drum 10', which includes four adjacently extending spirally-shaped cable grooves 12', on each drum half. Both of the groups of four are oppositely threaded so that cables 3 run off retaining drum 10' with all of the cables lying directly adjacently to each other, in one line, and run at constant spacing onto drive pulley 5 connected with motor 4. Cables 3 are again retained by clamping brackets 15 and secured by securing brackets 17.

Figure 4:
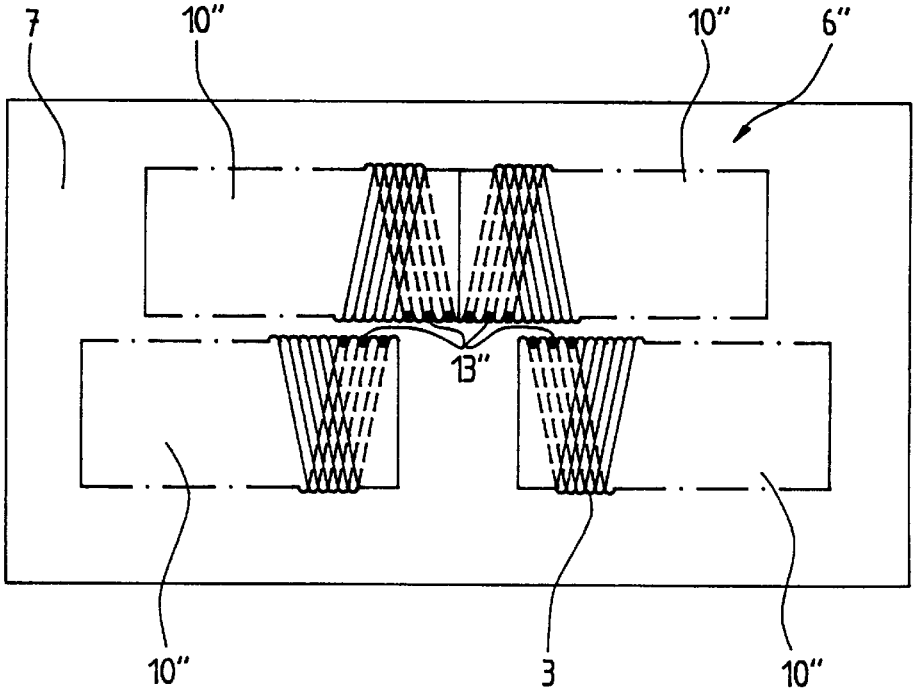
FIG. 4 is a schematic top plan view of a third exemplary embodiment of a cable-clamping device of this invention.
Figure 5:
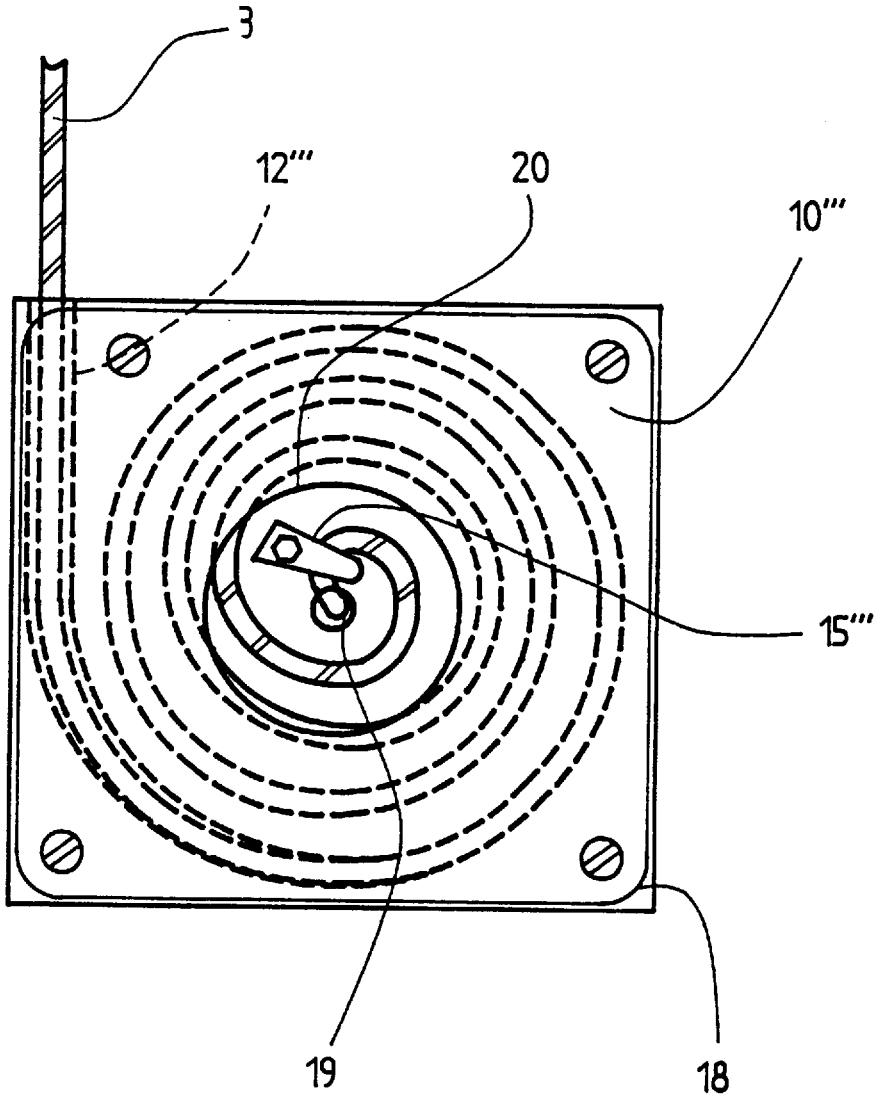
FIG. 5 is a side view of a fourth exemplary embodiment of a cable-clamping device of this invention.

The third exemplary embodiment shows how, with an arrangement of two or four retaining drums 10", practically as many cables 3 as desired can run one directly beside the other from cable-clamping device 6 without causing the retaining drums 10" to become too long. In cable-clamping device 6'" according to FIG. 4, two retaining drums 10" each, are arranged co-axially one behind the other, with two such pairs being adjacent to each other. Three cables 3 are wound onto each retaining drum 10", for a total of twelve of cables 3 altogether. Co-axially arranged retaining drums 10" include spirally-shaped cable grooves 12" and are respectively oppositely threaded, with cables 3 being wound in the same winding direction so that they tend, each time, towards the mutually opposite ends of retaining drums 10". Adjacently arranged retaining drums 10" likewise include oppositely threaded cable grooves 12", in this case however the winding direction of the cables 3 also being opposite. This causes that the run-off regions 13" of cable grooves 12" of all retaining drums 10" face each other. Thereby, all cables 3 run off, one directly adjacently to each other, and on about the same line.

The individual retaining drums 10" can, if needed, be constructed of very thin material, since the possible radius of curvature of synthetic material cable 3, depending upon its stiffness amounts to only one to six times that of the cable diameter. Thereby, cable-clamping device 6 can be adapted individually to the dimensions or space conditions at the counterweight and the car.

The cable-clamping device 6'", according to the fourth exemplary embodiment, includes spiral grooves (12'"), which are formed as planar curves that wind around a point. Retaining drums 10'" in this case take the form of flat discs having cable grooves 12'" milled into one end face and becoming gradually narrower in cross-section. Drums 10'", after the insertion of cable 3, are covered with a screwed-on flat cover 18. The next adjacent retaining drum 10'" can also take the place of lid 18. The unloaded cable end is retained by a clamping bracket 15'". For ease of retensioning, the cable end can be fed through a central opening 19 in retaining drum 10'" or a central passage 20 in lid 18. The passage 20 is expediently chosen to be so large that the screws of clamping bracket 15'" are accessible without removal of lid 18. Thus, lid 18 need only be loosened, but not removed altogether for retensioning purposes.

Cable-clamping device 6'" has the advantage of an extraordinarily narrow mode of construction, which however requires a somewhat greater overall height in the shaft direction than the previously described solutions.

Disc-shaped retaining drums 10'" can be arranged as groups of four, for example, as set forth in the third exemplary embodiment. When more than four cables are required, several retaining drums 10'" can be arranged one beside the other and displaced obliquely, each time, by one groove width of drive pulley 5, so that, when viewed transversely to the discs, the cables lie directly beside the each other.

Figure 6:
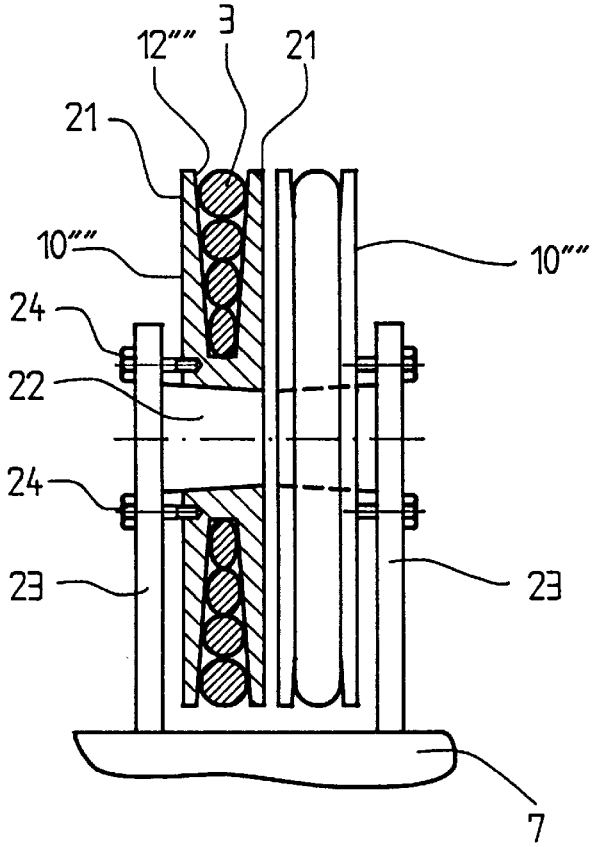
FIG. 6 is a partial sectional view of a fifth exemplary embodiment of a cable-clamping device of this invention.

The fifth exemplary embodiment, according to FIG. 6, shows a constructionally particularly simple and economically built-up cable clamping device 6"". The two mutually adjacent retaining drums 10"" consist of two unitary flat discs 21, preferably integrally connected together. Disposed therebetween each time is a cable groove 12"" that is slightly outwardly diverging and has a cable 3 spirally wound thereon. Cable grove 12"" continuously narrows from the entry of the cable towards the interior and laterally clamps only the inner portion of the cable 3. The superposed cable windings exert their greatest pressure on the innermost winding. The outermost cable winding, which is most stressed or loaded by the load, is thus not at all or only lightly laterally pressed.

Figure 7:
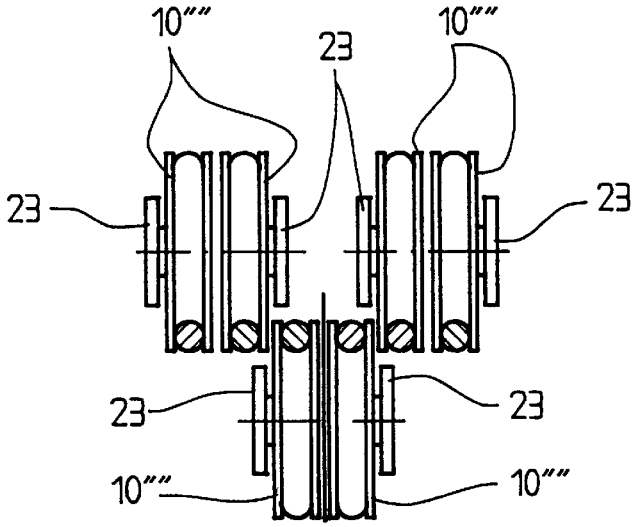
FIG. 7 is a variation of the embodiment of FIG. 6.

Retaining drum 10"" is axially pressed onto a cone 22, which is fixedly connected with a retaining bracket 23. In order to securely fix retaining drug 10"", it is fastened to retaining bracket 23 by screws 24. Obviously, two or any desired pairs of retaining drums 10"" can be arranged, in an offset manner adjacent to one another, as schematically indicated in FIG. 7.

For retightening of the cable, only screws 24 need be loosened and the retaining drum 10"" moved slightly relative to cone 22. Thereafter, retaining drum 10"" can be turned so far until the cable is again tensioned. In this manner cable 3 is further wound upon retaining drum 10"" without changing the departure point of the cable 3 transversely to the direction of the drive pulley grooves.

The description of the function of the first exemplary embodiment applies equally for the subsequent embodiments. Of course, individual features of one embodiment, such as for example single piece and two piece retaining drums, or the arrangement of the retaining drums relative to each other, can be interchanged with those of the other embodiments.

While there are shown and described present preferred embodiments of the invention, it is to be distinctly understood that the invention is not limited thereto, but may be otherwise variously embodied and practiced within the scope of the following claims and the reasonably equivalent structures thereto. Further, the invention illustratively disclosed herein may be practiced in the absence of any element which is not specifically disclosed herein.

What I claim is:

1. A cable-clamping device for load-bearing synthetic fiber cables for suspending an elevator car, the device comprising:

at least one retaining drum having at least one cable groove for the reception of the load-bearing cable;

the at least one retaining drum being firmly connected with at least one of the car and the counterweight of an elevator and having a plurality of adjacent cable grooves on the at least one retaining drum;

the cable grooves having groove courses that one of terminate and phase out directly beside each other at a run-off region of the retaining drum; and the cable grooves becoming narrower, in cross-section, from the run-off region, at which cables under load enter the cable grooves, to ends of the cable grooves opposite the run-off region.

2. The cable-clamping device of claim 1, further including several retaining drums arranged in one of a row and adjacent to each other, wherein run-off regions of the cable grooves face each other.

3. The cable clamping device of claim 1, wherein the cable groove is of a size to accept several superposed windings of the cable.

4. The cable clamping device of claim 2, wherein the cable groove is of a size to accept several superposed windings of the cable.

5. The cable-claiming device of claim 1, further including co-axially arranged cable grooves, each groove being wound with cables to about half of an axial extent of the cable grooves in an oppositely threaded manner.

6. The cable-claiming device of claim 2, further including co-axially arranged cable grooves, each groove being wound with cables to about half of an axial extent of the cable grooves in an oppositely threaded manner.

7. The cable-clamping device of claim 1, wherein the cables, at unloaded ends thereof, are retained in the cable grooves by lateral pressure, via clamping brackets.

8. The cable-clamping device of claim 2, wherein the cables, at unloaded ends thereof, are retained in the cable grooves by lateral pressure, via clamping brackets.

9. The cable-clamping device of claim 3, wherein the cables, at unloaded ends thereof, are retained in the cable grooves by lateral pressure, via clamping brackets.

10. The cable-clamping device of claim 5, wherein the cables, at unloaded ends thereof, are retained in the cable grooves by lateral pressure, via clamping brackets.

11. The cable-clamping device of claim 1, wherein the cables are secured in the cable grooves, against dropping-out, by securing brackets.

12. The cable-clamping device of claim 2, wherein the cables are secured in the cable grooves, against dropping-out, by securing brackets.

13. The cable-clamping device of claim 3, wherein the cables are secured in the cable grooves, against dropping-out, by securing brackets.

14. The cable-clamping device of claim 5, wherein the cables are secured in the cable grooves, against dropping-out, by securing brackets.

15. The cable-clamping device of claim 7, wherein the cables are secured in the cable grooves, against dropping-out, by securing brackets.

16. The cable-clamping device of claim 1, further including co-axially arranged retaining drums having cable grooves, with each groove being oppositely directed, wherein the cables are wound on in a same winding direction so that the fastened cable ends each tend to move towards the mutually remote ends of the retaining drums.

17. The cable-clamping device of claim 2, further including co-axially arranged retaining drums having cable grooves, with each groove being oppositely directed, wherein the cables are wound on in a same winding direction so that the fastened cable ends each tend to move towards the mutually remote ends of the retaining drums.

18. The cable-clamping device of claim 3, further including co-axially arranged retaining drums having cable grooves, with each groove being oppositely directed, wherein the cables are wound on in a same winding direction so that the fastened cable ends each tend to move towards the mutually remote ends of the retaining drums.

19. The cable-clamping device of claim 5, further including co-axially arranged retaining drums having cable grooves, with each groove being oppositely directed, wherein the cables are wound on in a same winding direction so that the fastened cable ends each tend to move towards the mutually remote ends of the retaining drums.

20. The cable-clamping device of claim 7, further including co-axially arranged retaining drums having cable grooves, with each groove being oppositely directed, wherein the cables are wound on in a same winding direction so that the fastened cable ends each tend to move towards the mutually remote ends of the retaining drums.

21. The cable-clamping device of claim 16, further including co-axially arranged retaining drums having cable grooves, with each groove being oppositely directed, wherein the cables are wound on in a same winding direction so that the fastened cable ends each tend to move towards the mutually remote ends of the retaining drums.

22. The cable-clamping device of claim 1, further including multiple adjacently arranged retaining drums, with the drums including oppositely directed cable grooves, wherein the winding direction of the cables is also oppositely directed.

23. The cable-clamping device of claim 2, further including multiple adjacently arranged retaining drums, with the drums including oppositely directed cable grooves, wherein the winding direction of the cables is also oppositely directed.

24. The cable-clamping device of claim 3, further including multiple adjacently arranged retaining drums, with the drums including oppositely directed cable grooves, wherein the winding direction of the cables is also oppositely directed.

25. The cable-clamping device of claim 5, further including multiple adjacently arranged retaining drums, with the drums including oppositely directed cable grooves, wherein the winding direction of the cables is also oppositely directed.

26. The cable-clamping device of claim 7, further including multiple adjacently arranged retaining drums, with the drums including oppositely directed cable grooves, wherein the winding direction of the cables is also oppositely directed.

27. The cable-clamping device of claim 11, further including multiple adjacently arranged retaining drums, with the drums including oppositely directed cable grooves, wherein the winding direction of the cables is also oppositely directed.

28. The cable-clamping device of claim 16, further including multiple adjacently arranged retaining drums, with the drums including oppositely directed cable grooves, wherein the winding direction of the cables is also oppositely directed.

29. The cable-clamping device of claim 1, wherein the cable grooves are spiral grooves arranged helically on the retaining drums.

30. The cable-clamping device of claim 2, wherein the cable grooves are spiral grooves arranged helically on the retaining drums.

31. The cable-clamping device of claim 3, wherein the cable grooves are spiral grooves arranged helically on the retaining drums.

32. The cable-clamping device of claim 5, wherein the cable grooves are spiral grooves arranged helically on the retaining drums.

33. The cable-clamping device of claim 7, wherein the cable grooves are spiral grooves arranged helically on the retaining drums.

34. The cable-clamping device of claim 11, wherein the cable grooves are spiral grooves arranged helically on the retaining drums.

35. The cable-clamping device of claim 16, wherein the cable grooves are spiral grooves arranged helically on the retaining drums.

36. The cable-clamping device of claim 22, wherein the cable grooves are spiral grooves arranged helically on the retaining drums.

37. The cable-clamping device of claim 1, wherein the cable grooves are planar spiral grooves winding around one point.

38. The cable-clamping device of claim 2, wherein the cable grooves are planar spiral grooves winding around one point.

39. The cable-clamping device of claim 3, wherein the cable grooves are planar spiral grooves winding around one point.

40. The cable-clamping device of claim 5, wherein the cable grooves are planar spiral grooves winding around one point.

41. The cable-clamping device of claim 7, wherein the cable grooves are planar spiral grooves winding around one point.

42. The cable-clamping device of claim 11, wherein the cable grooves are planar spiral grooves winding around one point.

43. The cable-clamping device of claim 16, wherein the cable grooves are planar spiral grooves winding around one point.

44. The cable-clamping device of claim 22, wherein the cable grooves are planar spiral grooves winding around one point.

45. The cable-clamping device of claim 29, wherein the cable grooves are planar spiral grooves winding around one point.

* * * * *